United States Patent [19]

Sapp

[11] 4,122,646

[45] Oct. 31, 1978

[54] EQUILATERAL DERRICK STRUCTURE

[75] Inventor: Dennis H. Sapp, Terre Haute, Ind.

[73] Assignee: Research-Cottrell, Inc., Chicago, Ill.

[21] Appl. No.: 804,611

[22] Filed: Jun. 8, 1977

[51] Int. Cl.[2] ..... E04H 12/06

[52] U.S. Cl. ..... 52/648; 403/171; 403/176; 405/197

[58] Field of Search ..... 52/638, 637, 648, 650; 61/88, 87, 96, 86; 403/171, 172, 176

[56] References Cited

U.S. PATENT DOCUMENTS

| | | | |
|---|---|---|---|
| 217,316 | 7/1879 | Asper | 52/638 |
| 569,687 | 10/1896 | Nodd | 403/176 |
| 2,186,190 | 1/1940 | Bauer | 403/171 |
| 3,094,847 | 6/1963 | Pogonowski | 61/96 |
| 3,688,461 | 9/1972 | Rensch | 52/650 |
| 3,999,351 | 12/1976 | Rensch | 52/282 |

FOREIGN PATENT DOCUMENTS

| | | | |
|---|---|---|---|
| 163,024 | 5/1949 | Austria | 52/638 |
| 109,952 | 8/1968 | Denmark | 61/96 |
| 477,515 | 6/1953 | Italy | 52/638 |

*Primary Examiner*—Price C. Faw, Jr.

*Assistant Examiner*—Henry Raduazo

*Attorney, Agent, or Firm*—Wegner, Stellman, McCord, Wiles & Wood

[57] ABSTRACT

An equilateral derrick structure such as for use in erecting chimneys and the like, wherein a plurality of horizontal members, upright diagonal brace members, and vertical column members are interconnected by a plurality of connectors to provide a desired three-dimensional framework derrick. The horizontal members may define a first kind of structural element, the brace members may define a second kind of structural element differing from the first kind, and the column members may define a third kind of structural element differing from each of the first and second kinds. The connectors may be formed as unitary members having a center portion defining a right circularly cylindrical hole for receiving corresponding right circularly cylindrical column members. The connectors may further define outwardly projecting flanges for connection of the horizontal members and diagonal brace members thereto. The connectors may have a circular inner configuration and a hexagonal outer configuration coaxial to the axis of the column mounting hole.

10 Claims, 7 Drawing Figures

Fig. 3
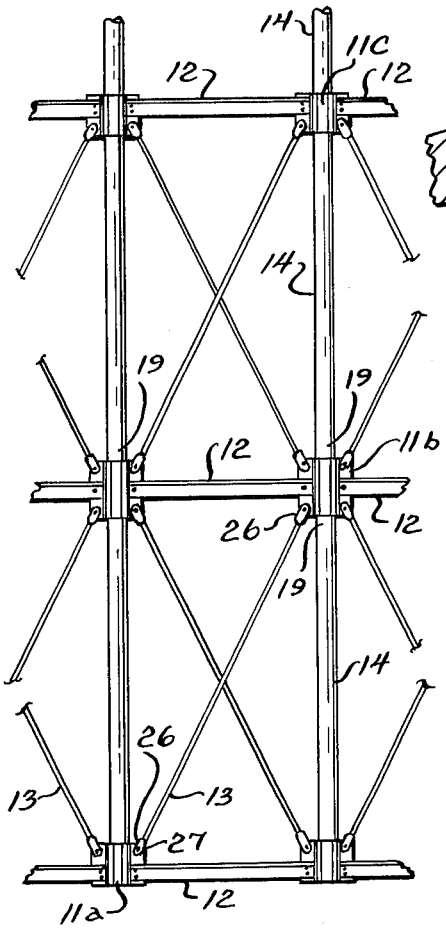
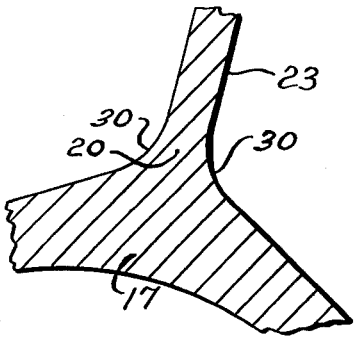
Fig. 7
Fig. 4
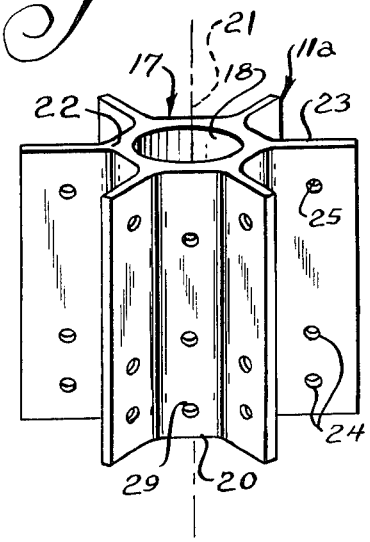
Fig. 5
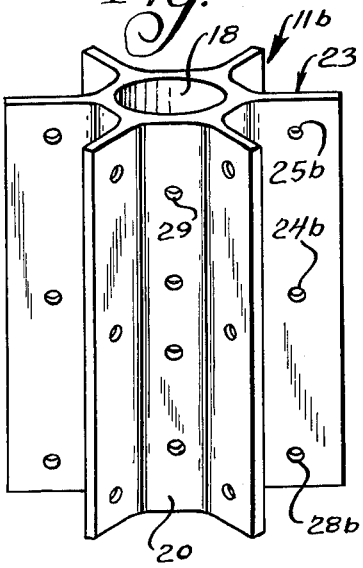
Fig. 6
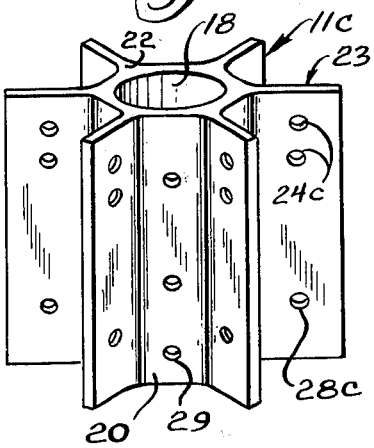

EQUILATERAL DERRICK STRUCTURE

BACKGROUND OF THE INVENTION

1. Field of the Invention

This invention relates to temporary construction derrick structures and in particular to readily assembled derrick structures wherein elongated members thereof are interconnected by a plurality of connector elements.

2. Description of the Prior Art

In the construction of derrick structures and the like, it is desirable to provide readily assembleable and disassembleable members permitting the derrick structure to be constructed in a framework configuration on the building site and permitting the framework to be readily added to and subtracted from as the need arises in the construction process. A number of different latticework, or derrick configurations have been developed for use in such applications.

Illustratively, in U.S. Pat. No. 140,455 of Adolphus Bonazano, a building construction is disclosed wherein a plurality of columns and girders are interconnected such as for use in buildings bridges viaducts, warehouses, etc. The connectors comprise 90-degree arcuate sections which may be suitably joined as by bolts or rivets to interconnect the beams and girders.

In U.S. Pat. No. 225,060 of Job Johnson, a column support is shown having threaded annular recesses in a plurality of connectors for connecting different diameter tubular columns.

Thomas A. Neill, in U.S. Pat. No. 933,386, shows an oil well derrick wherein horizontal girders and diagonal braces are connected to a plurality of connectors comprising split tubular members provided with a plurality of outwardly projecting flanges. The connectors clamp the tubular columns upon constriction thereof about the ends of the columns. The girders and braces are provided with flatted ends for connection to the flanges by suitable bolts.

Richard R. Bloss, in U.S. Pat. No. 1,400,408, shows a derrick fitting which is generally similar to that of Neill in providing a split tubular element having a plurality of flanges for connection of a plurality of tubular girder members to a plurality of tubular columns and a plurality of rodlike braces.

In U.S. Pat. No. 1,531,962 of John Lloyd, a joint for a tubular frame is shown to be made up of a plurality of leaved elements.

Fred D. Bearly, in U.S. Pat. No. 1,880,231, shows a derrick leg coupling wherein tubular column members are secured in a split connector having a plurality of flanges for connection thereto of tubular girders and flat braces.

A connecting sleeve is shown in U.S. Pat. No. 1,955,074 of Jacob C. Knupp, wherein a split connector is provided with hinge means for interconnecting the split portions of the connector, one of which portions is provided with a plurality of flanges for connection of angle girder members thereto.

A knockdown scaffold structure is shown by Joseph F. Manion in U.S. Pat. No. 2,237,572 for connecting square cross section columns to a plurality of girders and diagonal braces.

Richard Buckminster Fuller shows, in U.S. Pat. No. 2,682,235, a geodesic building construction utilizing a plurality of interconnected elongated members joined by suitable connectors.

Eberhard G. Rensch shows a framework for building structures in U.S. Pat. No. 3,688,461 wherein the connectors define hexagonal inner configurations for connection thereto of correspondingly hexagonal columns. In a three-dimensional latticework, Rensch teaches the use of flatted rods connected to the flanges.

Maurice Numa Louis Viandon shows, in U.S. Pat. No. 3,807,120, scaffolding structures utilizing struts which telescopically engage between booms of the framework.

In U.S. Pat. No. 3,914,063, Hristo V. Papyoti shows a connecting fixture for a space frame system wherein a plurality of flanges are welded to a flat base plate for interconnecting a plurality of U-shaped elongated members.

SUMMARY OF THE INVENTION

The present invention comprehends an improved form of derrick structure which is extremely simple and economical of construction while yet providing facilitated assembly and disassembly.

More specifically, the derrick structure of the present invention includes horizontal members, diagonal brace members, vertical column members, and a plurality of connectors interconnecting the horizontal, brace, and column members to form a framework derrick defined by a plurality of interconnected equilateral sections, the horizontal members comprising a first form of structural element, the brace members comprising a second form of structural element differing from the first form, and the column members comprising a third form of structural element differing from the first and second forms.

In the illustrated embodiment, the horizontal members may comprise elongated structural members having angularly related flat portions, and more specifically, structural angle elements.

The brace members may comprise rod elements and the column members may comprise right circularly cylindrical tubular elements.

The connectors may have a center portion defining a right circularly cylindrical hole for receiving the end of the column member, and in the illustrated embodiment, the center portion defines a through bore.

The external configuration of the connection may be hexagonal with flanges projecting outwardly from the apices of the hexagonal configuration for interconnection therewith of the horizontal and brace members.

The flanges may be integrally connected to the center portion of the connector member and may be provided with relatively large radius fillets for improved stress distribution.

The horizontal members may be connected to the flanges by a relatively large diameter connector, such as a 1 inch bolt, for further facilitated assembly and disassembly.

Thus, the derrick structure of the present invention is extremely simple and economical of construction while yet providing the highly desirable improvements discussed above.

BRIEF DESCRIPTION OF THE DRAWING

Other features and advantages of the invention will be apparent from the following description taken in connection with the accompanying drawing wherein:

FIG. 3 is a fragmentary enlarged side elevation thereof;

FIG. 4 is a perspective view of a connector utilized in the derrick structure embodying the invention;

FIG. 5 is a perspective view of a modified form of connector for use therein;

FIG. 6 is a perspective view of still another modified form of connector for use therein; and FIG. 7 is a fragmentary horizontal cross section of a portion of the connector illustrating the provision of the fillet at the junction of the flange with the center portion of the connector.

DESCRIPTION OF THE PREFERRED EMBODIMENT

Figure 1:
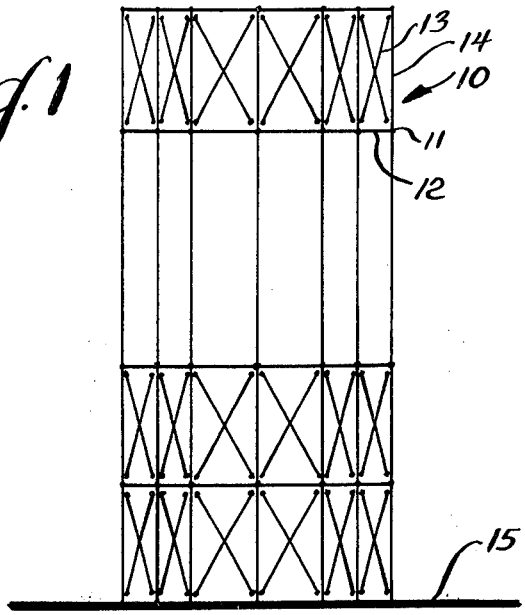
FIG. 1 is a schematic elevation of a derrick structure embodying the invention.
Figure 2:
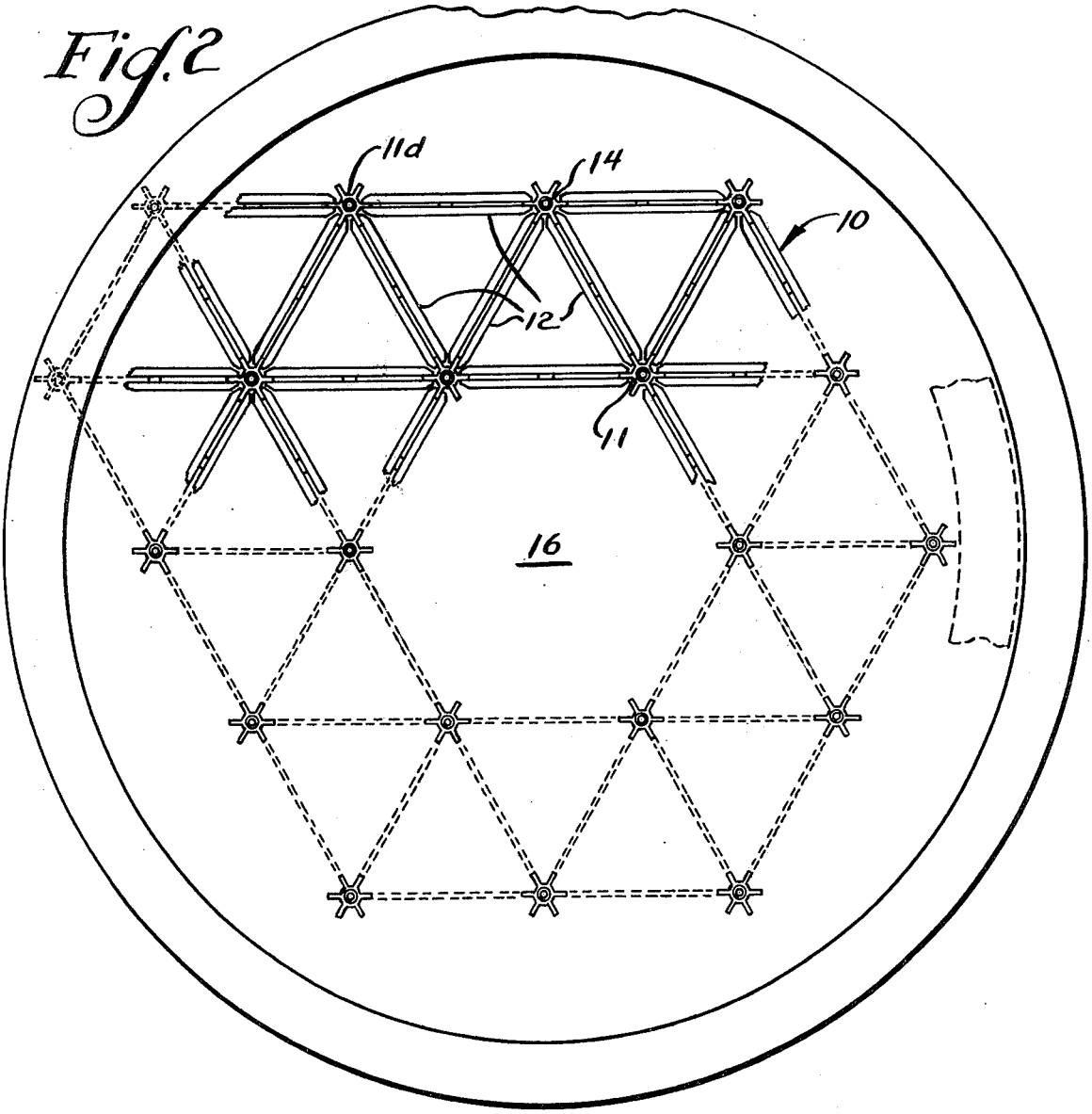
FIG. 2 is a fragmentary top plan view thereof with portions shown schematically.

In the exemplary embodiment of the invention as disclosed in the drawing, a derrick structure generally designated 10 is shown to comprise a three-dimensional framework, or latticework, formed of a plurality of connectors 11 interconnecting a plurality of horizontal members 12, diagonal brace members 13, and vertical column members 14. As shown in FIG. 1, the derrick may comprise a built-up framework suitably supported as on a base surface 15 such as the ground surface. Subsequently, the derrick may be supported by cables suspended from the structures being constructed as the height of the structure is increased. As shown in FIG. 2, the derrick may define a central access space 16 through which construction materials may be raised to the work platform. In the illustrated embodiment, the derrick is advantageously adapted for constructing relatively tall chimneys and the like, with the chimney being built about the derrick and with different additional levels of the derrick being readily assembled to the derrick structure as the construction height increases.

As further illustrated in FIG. 2, the derrick construction defines a plurality of equilateral sections with the horizontal members 12 arranged in equilateral triangular configurations. As shown in FIG. 2, the lateral extent of the derrick may be made to be as desired by the user with outboard equilateral sections being added as desired to the innermost equilateral sections.

The present invention comprehends the provision of a unique connector construction as illustrated in FIGS. 4, 5 and 6. In the illustrated embodiment, the connectors 11 may be provided in three different forms, namely, form **11*a* of FIG. 4, 11*b* of FIG. 5, and form 11*c* of FIG. 6. In each of the different forms, the connector defines a center portion 17 defining a right circularly cylindrical hole 18 for receiving the end 19 of the upright columns 14. The hole is defined by a through hole extending axially of the center portion 17. As shown in each of FIGS. 4, 5 and 6, the external configuration of the center portion is hexagonal, being defined by a plurality of flats 20 disposed in a hexagonal array about the central axis 21 of the center portion 17**.

Projecting radially outwardly from the apices 22 of the hexagonal array of flat surfaces 20 is a plurality of connecting flanges 23.

Connector **11*a* is arranged to provide a lower connection, as shown in FIG. 3, wherein the horizontal members 12 are connected to the lower portion of the connector and the diagonal brace members 13** are connected to an upper portion thereof.

Thus, as shown in FIG. 4, the lower portion of the flanges 23 may be provided with a pair of bolt holes 24 for connecting the ends of the horizontal members 12 thereto and the upper portion of the flanges may be provided with a bolt hole 25 for connecting the ends of the diagonal braces 13 thereto. As shown in FIG. 3, the ends of the braces may be provided with suitable clevises 26 for straddling the flanges and permitting the connection to be made to the flange by means of a suitable clevis pin 27. Thus, the diagonal brace members may be arranged at any suitable desired angle in the framework derrick structure.

As further shown in FIG. 3, a clevis 26 is provided at each of the opposite ends of the brace members 13 which, in the illustrated embodiment, may comprise rod elements having the clevises threadedly secured to the opposite ends thereof.

As shown in FIG. 3, connector **11*b* is adapted for installation at a midportion of the derrick wherein the upright columns 14 extend both upwardly and downwardly therefrom. Thus, as shown in FIG. 5, the connector 11*b* is arranged to provide a horizontal member mounting hole 24*b* in the midportion of the connector flanges, an upper brace mounting hole 25*b* provided in an upper portion thereof, and a brace mounting hole 28*b* in a lower portion thereof. Thus, as shown in FIG. 3**, the connector is adapted for connection of braces extending both upwardly and downwardly from the connector as well as for the connection of columns extending both upwardly and downwardly therefrom.

In FIG. 6, the connector **11*c* is shown to comprise a connector wherein a pair of horizontal member mounting holes 24*c* are provided in an upper portion of the flanges and a brace member mounting hole 28*c* is mounted in a lower portion thereof. Thus, as shown in FIG. 3, connector 11*c* is adapted for connecting only downwardly extending brace members thereto while concurrently mounting both upwardly and downwardly projecting columns 14** in horizontal members thereto.

In each of the different connectors **11*a*, 11*b* and 11*c*, the center portion is provided with a plurality of holes 29** such as for use in connecting the column members to the connector.

Referring to FIG. 7, the flanges 23 are preferably formed unitarily integral with the center portion 17 of each connector and the junction of the flanges with the center portion may be defined by suitable rounded fillets 30 which, in the illustrated embodiment, have a radius of approximately ¾inch. The fillets have been found to provide improved stress distribution in the connectors substantially improving the strength of the connectors and the safety of the derrick construction.

In the illustrated embodiment, the horizontal member mounting hole **24*b* is made to be relatively large, such as approximately 1 inch in diameter, so as to facilitate connection of the horizontal members 12** thereto.

As shown in FIG. 3, the horizontal members may comprise structural members having flatted surfaces, such as the angle iron members illustrated therein. As will be obvious to those skilled in the art, similar flatted structural elements, such as beams and channels, may similarly be utilized in the derrick structure as the horizontal members. As indicated briefly above, the diagonal brace members may comprise rod members, and as further indicated briefly above, the columns 14 may comprise right circularly cylindrical tubular members adapted to be received in the right circularly cylindrical bores 18. The use of the right circularly cylindrical column configuration permits the column to be formed of conventional tubular post material thereby minimizing cost and permitting use of conventional structural elements adapted for other uses. Thus, the invention comprehends the utilization of different kinds, or forms, of the elongated structural elements in the derrick construction with the connectors 11 being adapted for facilitated connection of these different structural elements thereto.

Further, the invention comprehends, the utilization of a center portion of the connector having a circular internal cross section and a hexagonal external cross section. As discussed above, the use of the flanges at the apices of the hexagonal external configuration provides a six-flange connector adapted for facilitated use in an equilateral derrick construction as shown in FIG. 2. As shown therein, in certain of the connections, each of the flanges is utilized relative to the horizontal members as well as relative to the diagonal brace members. In other portions of the derrick structure, less than all of the flanges may be utilized as required, such as shown at connector 11*d* of FIG. 2.

In the illustrated embodiment, the connectors are formed by extrusion of a suitable metal, such as aluminum. The extrusion may be formed substantially continuously with the connectors being cut to length as desired to provide the different connectors discussed above. The specific connectors may be mass produced in substantially quantities for further minimization of the cost of construction of the derrick.

As discussed above, the provision of the fillets 30 effectively minimizes breaking of the flanges from the center portion as by application of transverse loads thereto and permits facilitated storage and handling in the assembly and disassembly of the derrick.

The connectors of the present invention avoid the weaknesses of the conventional connectors utilizing split annular center portions and provide for accurate location of the flanges about the axis of the connectors for further minimizing of stresses therein in the derrick construction. The flanges may be arranged to effectively center the stresses produced in the derrick construction on the axis of the center portion for further improved deformation resistance and safety in the construction.

The clevis pins may be secured by suitable conventional hairpin-type cotter pins. The bolts may be secured against release by suitable washers. In the illustrated embodiment, the washers are preferably formed of stainless steel.

The foregoing disclosure of specific embodiments is illustrative of the broad inventive concepts comprehended by the invention.

I claim:

1. A derrick structure comprising:

horizontal angle members;

diagonal brace rod members;

vertical column right cylindrically tubular members; and a plurality of connectors readily removably interconnecting said horizontal, brace, and column members at a plurality of connections to form a rigid, readily assembleable and disassembleable framework derrick defined by a plurality of interconnected equilateral horizontal sections, said connectors having a configuration suitable to have each of at least one said horizontal, brace, and column members secured thereto.

2. The derrick structure of claim 1 wherein said center portion socket defines a through hole for receiving the ends of oppositely extending corresponding said column members therein.

3. The derrick structure of claim 1 wherein said connectors define an external hexagonal configuration.

4. The derrick structure of claim 1 wherein said connectors define an external hexagonal configuration coaxially of said socket.

5. The derrick structure of claim 1 wherein said flanges are integrally joined to the center portion and defining rounded fillets at the juncture therewith, said fillets having a large radius of approximately $\frac{3}{4}$ inch.

6. A derrick structure comprising:

horizontal angle members;

diagonal brace rod members;

vertical column right circularly cylindrical tubular members; and a plurality of connectors readily removably interconnecting said horizontal, brace, and column members at a plurality of connections to form a rigid, readily assembleable and disassembleable framework derrick defined by a plurality of interconnected equilateral horizontal sections, each of said connectors comprising a unitary member having a center portion defining a right circularly cylindrical socket for receiving an end of a corresponding column member therein and flanges radiating from said center portions and connected to end portions of the angle and brace members.

7. The derrick structure of claim 6 wherein said connectors define an external hexagonal configuration coaxially of said socket, said flanges projecting one each from the apices of the hexagonal outer surface of the connectors to define a plurality of connecting flanges spaced angularly 60° about the axis of said socket.

8. The derrick structure of claim 6 wherein said flanges have a 1 inch hole for receiving bolts connecting the horizontal members to said connector.

9. The derrick structure of claim 6 wherein said brace members are provided with a clevis for straddling said flanges, pin means being provided for connecting the clevis adjustably to the flange to permit the brace member to extend therefrom at a preselected angle in the framework derrick.

10. The derrick structure of claim 6 wherein said flanges are integrally joined to the center portion and define rounded fillets at the juncture therewith.

* * * * *